US010258817B2

(12) United States Patent
Bygbjerg et al.

(10) Patent No.: US 10,258,817 B2
(45) Date of Patent: Apr. 16, 2019

(54) SPRAY HEAD FOR A UNIFORM FLUID DISTRIBUTION AND A FLUID DISTRIBUTION SYSTEM

(75) Inventors: Henrik Bygbjerg, Kirke Hyllinge (DK); Steen Gaardsted Kristensen, Nordborg (DK); Carsten Windt, Odense (DK); Jens Toft Jepsen, Klarup (DK)

(73) Assignee: DANFOSS SEMCO A/S, Odense C (DK)

( * ) Notice: Subject to any disclaimer, the term of this patent is extended or adjusted under 35 U.S.C. 154(b) by 752 days.

(21) Appl. No.: 13/703,906

(22) PCT Filed: May 21, 2011

(86) PCT No.: PCT/DK2011/000048

§ 371 (c)(1), (2), (4) Date: Feb. 4, 2013

(87) PCT Pub. No.: WO2011/157269

PCT Pub. Date: Dec. 22, 2011

(65) Prior Publication Data

US 2013/0126192 A1 May 23, 2013

(30) Foreign Application Priority Data

Jun. 15, 2010 (DK) ..... 2010 00521

(51) Int. Cl.

| | |
|---|---|
| ***A62C 31/05*** | (2006.01) |
| ***A62C 37/08*** | (2006.01) |
| ***A62C 37/14*** | (2006.01) |

(52) U.S. Cl.

CPC ..... *A62C 37/08* (2013.01); *A62C 31/05* (2013.01); *A62C 37/14* (2013.01)

(58) Field of Classification Search

CPC ..... A62C 31/05; A62C 37/08

(Continued)

(56) References Cited

U.S. PATENT DOCUMENTS 822,546 A * 6/1906 Newman ..... B05B 1/14 169/37
2,647,800 A * 8/1953 Burnam ..... B05B 1/14 239/543

(Continued)

FOREIGN PATENT DOCUMENTS

CN 1391493 A 1/2003
EP 1 413 333 A1 6/2003

(Continued)

OTHER PUBLICATIONS

PCT Search Report for PCT Serial No. PCT/DK2011/000048 dated Sep. 6, 2011.

(Continued)

*Primary Examiner* — Jason J Boeckmann
(74) *Attorney, Agent, or Firm* — McCormick, Paulding & Huber LLP

(57) ABSTRACT

The present invention relates to a spray head for effective fire fighting. The spray head according to the present invention provides a uniform distribution of a fluid, such as pressurized water, over a relatively large area. To achieve this, the spray head comprises a body defining a central axis and further comprising a fixation structure for fixing the spray head to a fluid supply system, a fluid inlet, directing fluid in a first direction, a plurality of outlet holes arranged around the central axis, and a flow path between the inlet and the holes, wherein a first set of holes are located in such a way, that the fluid is leaving the first set of holes in a second direction opposite to the first direction and wherein the body further comprises an arrangement for holding a fire actuation member.

9 Claims, 5 Drawing Sheets

A-A

(58) Field of Classification Search
USPC ..... 239/548, 556, 558, 589, 119; 169/37, 90
See application file for complete search history.

(56) References Cited

U.S. PATENT DOCUMENTS

| | | | | | |
|---|---|---|---|---|---|
| 4,700,894 | A * | 10/1987 | Grzych | A62C 31/02 169/70 |
| 5,419,496 | A * | 5/1995 | Novak, Jr. | 239/530 |
| 5,513,708 | A | 5/1996 | Sundholm | |
| 5,531,275 | A | 7/1996 | Sundholm | |
| 6,318,474 | B1 * | 11/2001 | Sundholm | A62C 31/02 169/37 |
| 7,370,815 | B2 * | 5/2008 | Fecht | B05B 1/3426 239/490 |
| 7,793,864 | B2 * | 9/2010 | Decarne | B05B 3/0427 134/166 C |
| 2004/0144549 | A1 * | 7/2004 | Sundholm | A62C 37/14 169/37 |
| 2004/0251319 | A1 * | 12/2004 | Sundholm | A62C 31/05 239/433 |
| 2011/0121099 | A1 * | 5/2011 | Han | 239/263 |

FOREIGN PATENT DOCUMENTS

| | | | |
|---|---|---|---|
| FR | 753.996 | | 10/1933 |
| FR | 2 808 229 | A1 | 11/2001 |
| GB | 2 438 830 | A | 12/2007 |
| JP | 08-206247 | A | 8/1996 |
| JP | 09-285562 | A | 11/1997 |
| JP | 2008-029789 | A | 2/2008 |
| WO | 99/34872 | A1 | 7/1999 |
| WO | 03/022364 | A1 | 3/2003 |
| WO | 2007/110457 | A1 | 10/2007 |
| WO | 2008/034445 | A1 | 3/2008 |

OTHER PUBLICATIONS

European Search Report on European Patent Application No. EP 11 795 218.4 dated Nov. 22, 2016.

* cited by examiner

SPRAY HEAD FOR A UNIFORM FLUID DISTRIBUTION AND A FLUID DISTRIBUTION SYSTEM

CROSS REFERENCE TO RELATED APPLICATIONS

This application is entitled to the benefit of and incorporates by reference essential subject matter disclosed in International Patent Application No. PCT/DK2011/000048 filed on May 21, 2011 and Danish Patent Application No. PA 2010 00521 filed Jun. 15, 2010.

TECHNICAL FIELD

The present invention relates to a spray head for uniform fluid distribution and a fluid distribution system. The spray head is of the type suitable for installation in an interior part of a building, vessel or a tunnel and in a distance from the ceiling. The fluid to be distributed, such as water, is passed through a number of outlet holes under high pressure, such as above 60 bar. In order to obtain the uniform distribution of, for example, water the holes are arranged in groups, each group being arranged in a circumferential manner around a central axis of the spray head. Furthermore, the groups of holes are angled differently relative to the central axis of the spray head.

BACKGROUND

When a fire fighting system is installed in an interior part of a building, vessel or tunnel it is normally desirable to mount the spray heads at positions close to a ceiling. This is due to aesthetic as well as practical reasons, since spray heads arranged at a distance from a ceiling are normally in the way with respect to the normal use of the room. However, sometimes it is not possible to mount the spray heads immediately adjacent to a ceiling. This is, for example, the case when bearing structures, iron girders, pipes, ventilating plant, lamps etc., are located at positions at or near the ceiling. The problem is often seen in warehouses, sheds, garages, basements, vessels, tunnels etc. In this case the spray heads must be arranged further away from the ceiling than the bearing structure, lamps, pipes etc., since the bearing structure, lamp, pipes etc. would otherwise block a spray of fluid from a given spray head and the fire fighting system would not be able to operate in a correct manner. It may even be impossible for the fire fighting system to extinguish a fire under these circumstances.

Numerous implementations of spray heads for fire fighting systems have been suggested in the patent literature.

For example, FR-A-753996 discloses a spray head having a body defining a central axis and further comprising a fixation structure for fixing the spray head to a fluid supply system, a fluid inlet, a plurality of outlet holes arranged around the central axis, and a flow path between the inlet and the holes, wherein the fluid inlet is above the holes and the fluid is flowing from the inlet and down and out of the holes.

GB-A-2 438 830 discloses an apparatus for extinguishing fire in prison cells. The apparatus comprises a source of pressurized fire extinguishing agent and a manually operable lance connected to said source of fire extinguishing agent and insert able through a small inspection hole into the prison cells. The lance comprises an elongate lance tube and a nozzle head mounted to the distal end of said lance tube, said nozzle head has a size adapted to allow insertion through said hole, and said nozzle head being provided with a plurality of nozzle holes including holes directed in rearwardly inclined directions with respect to the longitudinal axis of said lance tube. An embodiment includes a nozzle head which has a rearward facing conical surface, a forward facing conical surface, a cylindrical circumferential surface and a forward facing end face, wherein all faces include nozzle holes.

EP 1 413 333 discloses a spray head having holes of various dimensions arranged in a semi-sphere. According to EP 1 413 333 holes of relatively small dimensions are arranged to fight fire occurring at a relatively large radial distance from the spray head whereas larger, and more downwardly oriented holes, are arranged to fight fire below the spray head. The holes of relatively small dimension are cylindrical in shape, whereas the downwardly oriented holes have a cylindrically shaped initial section being in fluidic communication with an essentially conically shaped outlet section.

WO 2008/034445 discloses a spray head having a body defining a central axis and further comprising a fixation structure for fixing the spray head to a fluid supply system, a fluid inlet, a plurality of outlet holes arranged around the central axis, and a flow path between the inlet and the holes, wherein the fluid inlet is above the holes and the fluid is flowing from the inlet and down and out of the holes, wherein a first set of holes are located at a larger radial distance from the central axis than a second set of holes, and wherein the second set of holes are located at a larger radial distance from the central axis than a third set of holes, and wherein the holes comprise an essentially identical expansion passage section.

WO 99/34872 discloses a holder for mounting a spray head. The holder is mounted in a ceiling, and a spray head is subsequently mounted in the holder. The spray head may be provided with a plate for hiding screws etc. used for mounting the holder to the ceiling.

The spray heads disclosed in EP 1 413 333, WO 2008/034445 and WO 99/34872 are all mounted at or close to a ceiling and are all fixed to the fluid supply system by being fixed to the underside of the supply system and do therefore all hang down from the fluid supply system.

Spray heads arranged at a distance from a ceiling and hanging down are normally in the way with respect to the normal use of the room. There is the risk that objects or persons could bump into the spray head and thereby be damaged or damage the spray head.

SUMMARY

It is thus an object of the invention to provide a spray head that, when mounted at a distance from a ceiling, is not in the way with respect to the normal use of the room.

In the present context the term "building" and the term "room" should be interpreted to mean buildings, vessels or tunnels. The building may be any kind of building such as a building being suitable for accommodation, an office building, an industrial building such as storage facilities, a factory, sport facilities, sheds, garages, basements, cavities, cable boxes etc.

An object of the invention is to provide a spray head that can be fixed to a supply system in such a way that the risk of bumping into the spray head is minimised.

Another object is to provide a spray head that can be fixed to a simple length of a pipe.

It is a further object of the invention to provide a spray head being able to cover a large area. It is an even further object of the invention to provide a fire fighting system in which the number of spray heads required to cover a given area with fluid can be reduced as compared to similar prior art fire fighting systems.

It is an even further object of the invention to provide a spray head which, when mounted at a distance from a ceiling, will be activated earlier than a similar prior art spray head.

The spray head according to the present invention is intended for forming part of a fire fighting system comprising a plurality of spray heads distributed over a ceiling of a room, a complete building, on a ship both outside and inside and inside installations, for example, electrical installations. The spray head is adapted to form an end part of a fluid conduit, such as a high pressure water conduit. By high pressure is meant that the water pressure may be as high as 100, 200 or 300 bar when the spray head is active, i.e. when water is distributed by the spray head.

The above-mentioned object is complied with by providing, in a first aspect a spray head comprising:

- a body defining a central axis and further comprising a fixation structure for fixing the spray head to a fluid supply system,
- a fluid inlet, directing fluid in a first direction,
- a plurality of outlet holes arranged around the central axis, and
- a flow path between the inlet and the holes, wherein a first set of holes is located in such a way that the fluid is leaving the first set of holes in a second direction opposite to the first direction and wherein the body further comprises an arrangement for holding a fire actuation member.

A spray head of the above type can be fixed on the top side of a supply system for example on the top side of a length of a pipe. By having the fluid leaving the first set of holes in a second direction opposite to the first direction will a fixation on the top side of the supply system will be possible without the fluid or mist blocking from the spray head itself or the supply system. A spray head provided to be fixed on the top side of the supply system solves the problem of risking bumping into a down-hanging spray head, thus damaging the spray head or the person or object bumping into it.

In a preferred embodiment of the spray head it is provided that an angle formed between the first direction of the fluid and the second direction is in the range between 125-175 degrees.

In another embodiment, the angle is in the range between 140-160 degrees, preferably between 145-155 degrees.

In another embodiment, the spray head is provided with the first set of holes located at a smaller radial distance from the central axis than a second set of holes. This provides a spray head that can produce a spray that can cover a larger surface area.

In still another embodiment of the spray head, the first set of holes is located closer to the fluid inlet than the second set of holes.

Fire fighting on large surface areas under the spray head is obtained by the fluid leaving the second set of holes in a third direction, and the angle formed between the first direction and the third direction being in the range between 89-139 degrees.

An embodiment with an angle formed between the first direction and the third direction of 104-124 degrees, preferably between 111-120 degrees, has proved advantageous.

The body of the spray head according to the present invention may comprise at least a first and a second circumferential surface part, the first and second circumferential surface parts forming first and second angles, respectively, to the central axis. Preferably, the first set of holes is arranged in the first circumferential surface part, and the second set of holes is arranged in the second circumferential surface part. The first set of holes may comprise a larger number of holes than the second set of holes. For example, the first set of holes may comprise 12 holes, whereas the second set of holes may comprise 6 holes. Obviously, these numbers may be chosen differently.

In one embodiment of the invention the holes comprise an expansion passage section. The expansion passages aid to form a fluid mist.

Each hole may comprise an initial passage section with a first cross sectional size, the initial passage section being in fluid communication with the expansion passage section having a second cross sectional size. The second cross sectional size may be larger than the first cross sectional size. The initial passage section may take an essentially cylindrical shape having a diameter in the range 0.5-2.5 mm. The expansion passage section may take an essentially conical shape having an opening angle in the range 40-80°, such as 50-70°, such as around 60°. The exterior opening of the expansion passage section obviously depends on the opening angle of the conical shape. As an example, the exterior opening for an expansion passage section having an opening angle of 60° is approximately 4.5 mm.

In order for, for example, water to leave the spray head a sharp end of the conically shaped expansion passage section may be oriented towards, and being in fluidic communication with, the essentially cylindrically shaped initial passage section.

Activation of the spray head may be provided by various means. In a preferred embodiment the spray head body may further comprise an arrangement for holding a fire actuator member. The fire actuator member may be an integrated activation arrangement such as a glass ampoule, which burst when the temperature around the spray head reaches a predetermined temperature for that specific glass ampoule. Glass ampoules covering the range from 55° C. to 350° C. are available. Before the spray head is activated, the water pressure in the water conduit may be, for example, 10 bar. Upon activation of the spray head the water pressure in the water conduit is slightly reduced due to the opening of the spray head. This lowered water pressure may be detected by a pressure sensor in the fire fighting system, which in response to the detected pressure drop, increases the water pressure to a higher level, such as 100 bar.

In a preferred embodiment of the spray head body, the fire actuation member is located opposite the fluid inlet. When the spray head is fixed to a fluid supply system, typically a supply pipe, the pipes will be placed at a distance from the ceiling and the spray head will be mounted on the top side of the pipe. The fluid will then, when the fire actuation member is activated, flow from the supply pipe into the fluid inlet of the spray head body and out through the outlet holes. By locating the actuation member opposite the fluid inlet, the actuation member will automatically be placed close to the ceiling. In the case of a fire, the heat will rise the closer you get to the ceiling. With the spay head according to the invention, the spray head may be activated earlier than conventional spray heads. Even a split second may have great influence on the effect of fighting a fire.

BRIEF DESCRIPTION OF THE DRAWINGS

The present invention will now be described in further details with reference to the accompanying drawings, where.

DETAILED DESCRIPTION

Figure 1A:
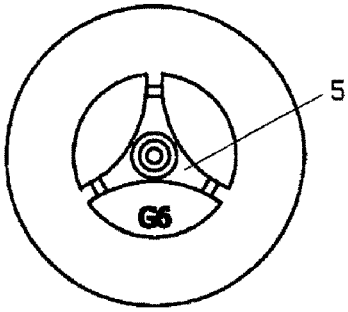
FIG. 1 shows a bottom, a side and a top view of the spray head according to the present invention.

In its broadest aspect the present invention relates to a fire fighting spray head capable of distributing fluid in a uniform manner when the spray head is fixed on the top side of a supply pipe. By uniform is meant that an area is provided with an essentially evenly distributed amount of fluid, such as water. This is done with a sufficient amount of fluid to control or extinguish the fire. In addition, the fire fighting spray head of the present invention is capable of distributing a fluid, such as water over a larger area compared to conventional spray heads, whereby the number of required spray heads forming a fire fighting system can be significantly reduced.

The spray head comprises a body 1 defining a central axis 2. The body 1 may be seen as comprising two parts—a fixation part 3 for connecting the spray head to a fluid supply system (not shown) and a distribution part 4 for distributing fluid for fire fighting according to wish. The spray head further comprises an arrangement 5 for holding a fire actuation member, here a glass ampoule (not shown). A gas bubble inside the glass ampoule will expand when the ampoule is heated, and eventually break the glass. The temperature at which the ampoule bursts can be controlled. This usually happens between 50 and 150° C. It should be noted that the fire actuation member may be implemented and configured in various ways. For example, externally positioned temperature sensors could also be used for activating the fire fighting system. Thus, the present invention should by no means be limited to any specific way of the implementing the fire actuation member.

The spray head can be made of, for example, brass, stainless steel or any other heat resistant material. The overall length of the spray head depicted in FIG. 1 is around 50 mm whereas the width of the spray head is around 35 mm. The spray head is designed to withstand fluidic pressures as high as 300 bar.

Figure 1B:
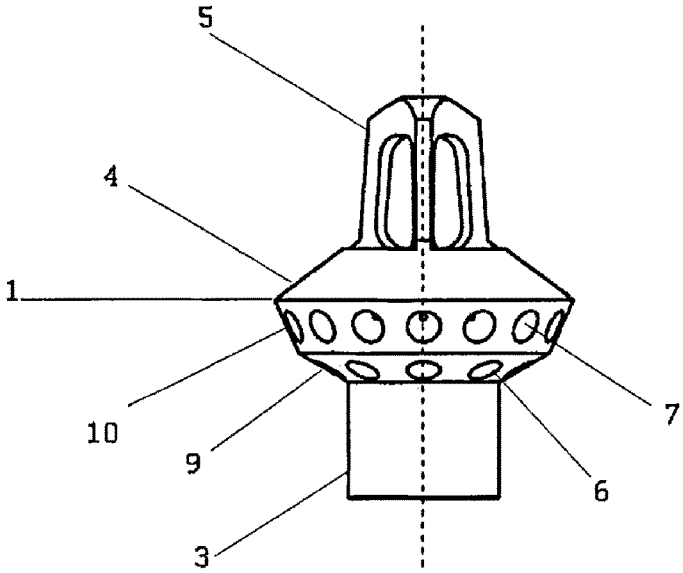
Figure 1C:
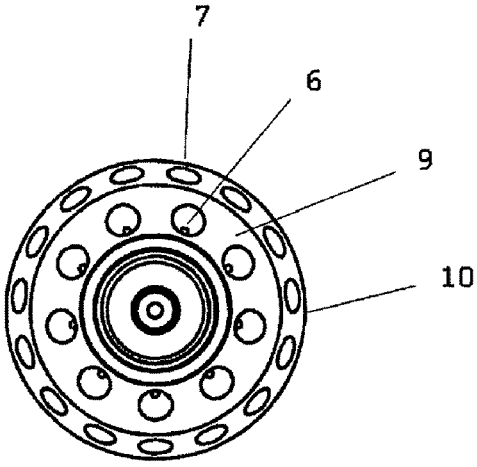

FIG. 1*a* shows a top view of a spray head, FIG. 1*b* a side view and FIG. 1*c* a bottom view.

As seen in FIGS. 1*b* and 1*c* the distribution part 4 of the spray head comprises angled facets 9 and 10 arranged in a circumferential manner around the central axis 2. Two sets of outlet holes 6 and 7 are arranged in respective ones of angled facets 9 and 10. Thus, if a pressurised fluid, such as water, leaves through the two sets of holes, fluid leaving through the upper set of holes 7 will reach the longest distance from the spray head, whereas fluid leaving through the lower set of holes 6 will reach the shortest distance from the spray head. Fluid simultaneously leaving through all holes will form an essentially uniform fluid distribution over a given area on a plane below the spray head in case the spray head is mounted in a ceiling of a room or a building.

Figure 2A:
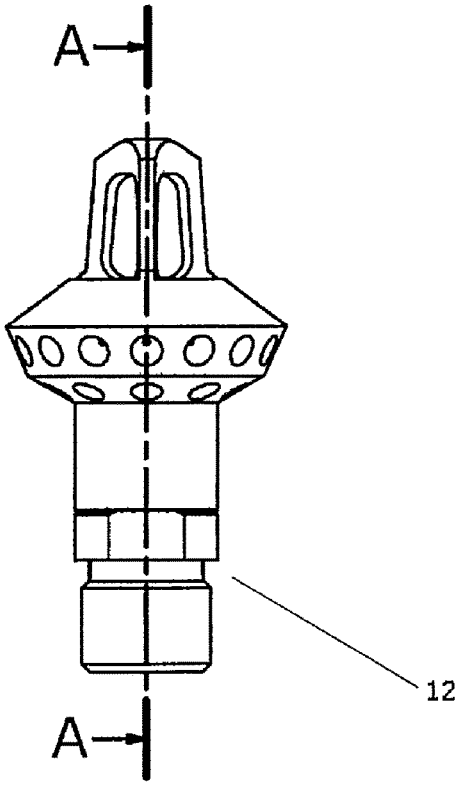
FIG. 2 shows a side view and a cross-sectional view of a closed spray head according to a first embodiment of the invention.
Figure 2B:
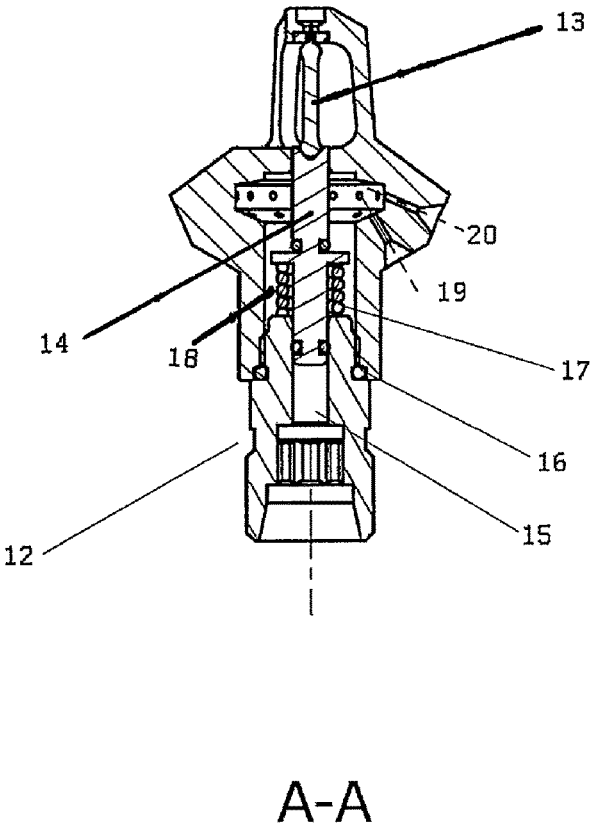

In FIG. 2 a side view of the spray head is shown in FIG. 2*a*, whereas FIG. 2*b* shows a cross-section profile along cut A-A. The spray head of FIG. 2 is connected to a fluid supply unit 12, such as a water supply unit. In addition, the spray head of FIG. 2 is depicted in a closed state in that the fire activation member 13, here a glass ampoule, is intact. The glass ampoule 13 maintains the displaceable valve element 14 in a position, where the fluid conduit 15 is blocked. As seen, a fluid tight sealing is provided with sealing element 16, which can be an O-ring. A linear spring 17 biases the displaceable valve element 14 in a forward direction so that, when the spray head is exposed to temperatures sufficient to burst the glass ampoule 13, the linear spring 17 displaces the valve element 14 in a forward direction, whereby fluid is allowed to enter the interior 18 of the body of the spray device. From the interior 18 the fluid is allowed to leave through holes 19 and 20.

Figure 3:
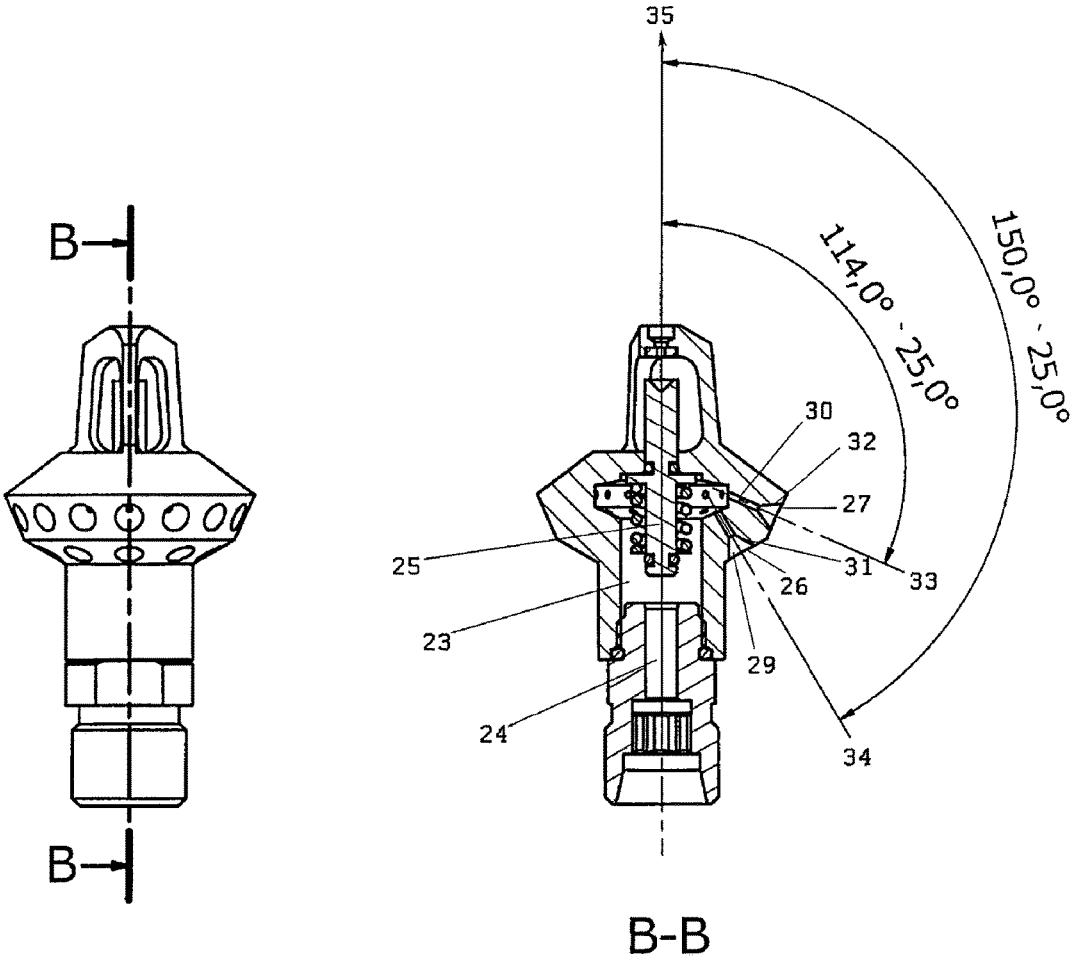
FIG. 3 shows a side view and a cross-sectional view of the first embodiment with activated spray head.

FIG. 3 shows a spray head in an open state of operation. Thus, in FIG. 3 the fluid is allowed to enter the interior 23 of the spray head via conduit 24. As seen in FIG. 3, the displaceable valve element 25 has been displaced to a front position, thereby creating a free fluid passage from conduit 24 to outlet holes 26 and 27. The pressure of the fluid may be of various sizes, but in the case of water being the fluid to be distributed via the spray head, a pressure of around 100 bar will be typical.

The holes of the spray head of the present invention have a cylindrically shaped initial passage section 29, 30 being in fluidic communication with a conically shaped expansion passage section 31, 32. The diameter of the cylindrically shaped sections 29, 30 is around 1 mm, whereas the opening angle of conically shaped sections is around 60°. The diameters of the openings of the conically shaped sections are around 4.5 mm. The respective spraying angles, indicated by axes 33, 34, measured in relation to the first direction of the fluid from the fluid inlet 35, are 150±25° for the first set of holes, the lower holes 29, 31, and 114±25° for the second set of holes, the upper holes 30, 32.

Figure 4:
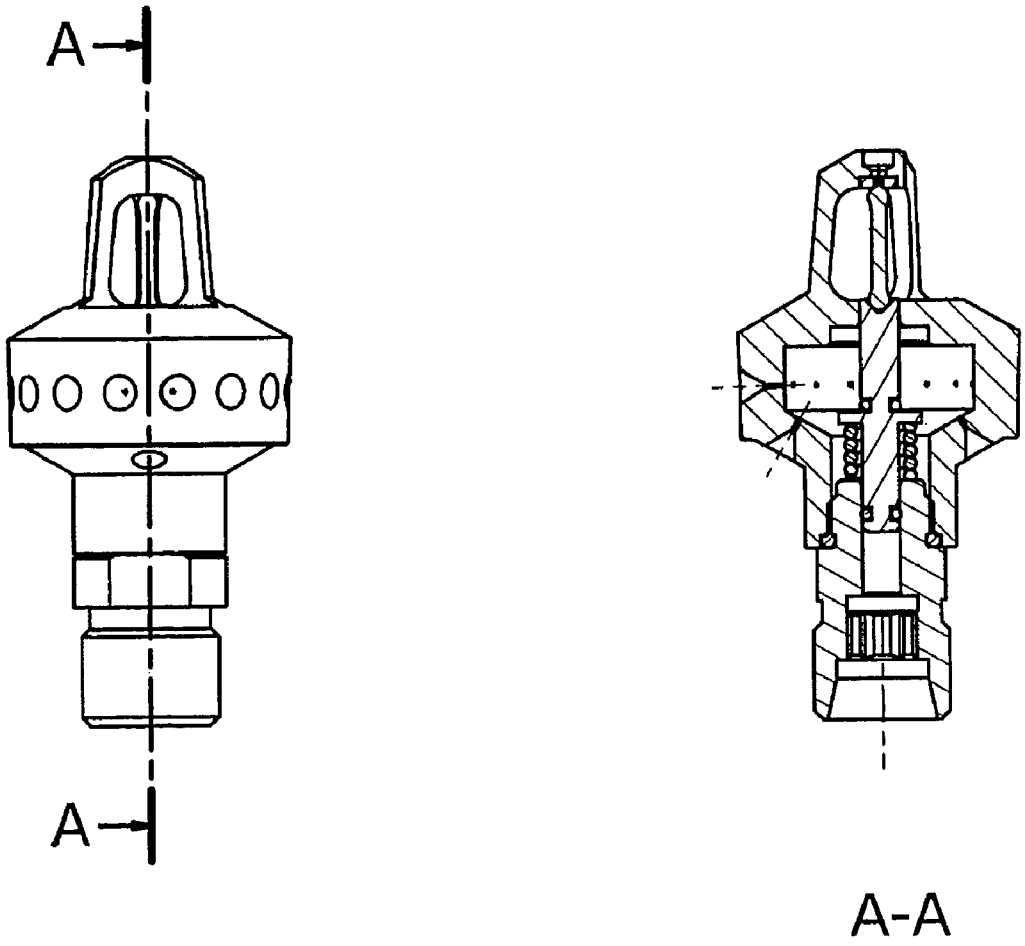
FIG. 4 shows a side view and a cross-sectional view of a closed spray head according to a second embodiment of the invention.
Figure 5:
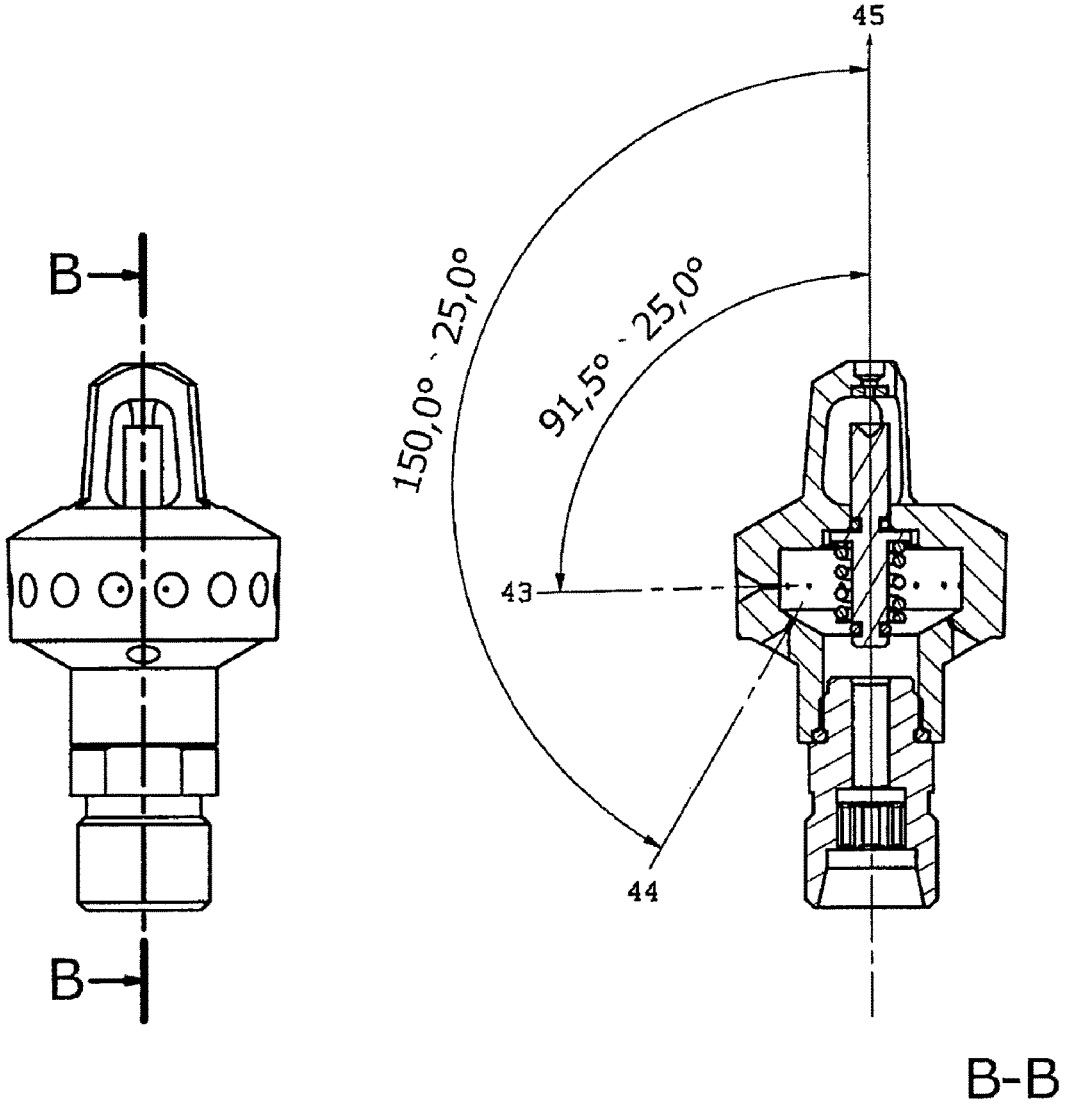
FIG. 5 shows the spray head of FIG. 4 with activated spray head.

FIG. 4 shows a second embodiment of the invention. FIG. 5 shows the second embodiment from FIG. 4 with activated spray head. The respective spraying angles, indicated by axes 43, 44 measured in relation to the first direction of the fluid from the fluid inlet 45 are 150±25° for the first set of holes, the lower holes, and 91.5±25° for the second set of holes, the upper holes. The spray head according to the second embodiment is suitable for rooms with low ceiling height, like cavities, cable boxes, etc.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

What is claimed is:

1. A spray head comprising:

a body defining a central axis and further comprising a fixation structure for fixing the spray head to a fluid supply system, a fluid inlet, directing fluid into an interior of the body in a first direction, a plurality of outlet holes arranged around the central axis, each outlet hole of the plurality of outlet holes comprising an initial passage section fluidly connected directly to the interior of the body, and a flow path through the interior of the body between the inlet and the holes, wherein a first set of the plurality of outlet holes is oriented to direct the fluid leaving the first set of the plurality of outlet holes in a second direction opposite to the first direction, wherein the body further comprises an arrangement for holding a fire actuation member, wherein an angle formed between the first direction of the fluid and the second direction is in the range between 140-160 degrees, wherein the first set of the plurality of outlet holes is located at a smaller radial distance from the central axis than a second set of the plurality of outlet holes, wherein the first set of the plurality of outlet holes is located closer to the fluid inlet than the second set of the plurality of outlet holes, wherein the second set of the plurality of outlet holes is oriented to direct the fluid leaving the second set of the plurality of outlet holes in a third direction, wherein an angle formed between the first direction and the third direction is in the range between 89-139 degrees, and wherein the initial passage section takes an essentially cylindrical shape, and being in fluid communication with an expansion section having an essentially conical shape extending all the way from the initial passage section to an exterior of the body.

2. The spray head according to claim 1, wherein the angle formed between the first direction of the fluid and the second direction is in the range between 145-155 degrees.

3. The spray head according to claim 1, wherein the angle formed between the first direction and the third direction is 104-124 degrees.

4. The spray head according to claim 1, wherein the body comprises at least a first and a second circumferential surface part, the first and second circumferential surface parts forming first and second angles respective to the central axis, the first set of the plurality of outlet holes being arranged in the first circumferential surface part, and the second set of holes being arranged in the second circumferential surface part.

5. The spray head according to claim 4, wherein the second set of the plurality of outlet holes comprises a larger number of holes than the first set of the plurality of outlet holes.

6. The spray head according to claim 1, wherein each initial passage section of the plurality of outlet holes comprises a first cross sectional size, the initial passage section being in fluid communication with the expansion passage section comprising a second cross sectional size, the second cross sectional size being larger than the first cross sectional size.

7. The spray head according to claim 1, wherein the arrangement for holding the fire actuation member is arranged opposite the inlet opening.

8. A fluid distribution system comprising a length of a pipe and a spray head according to claim 1, wherein the spray head is fixed on the top side of the pipe length.

9. The spray head according to claim 1, wherein the angle formed between the first direction and the third direction is between 111-120 degrees.

* * * * *